US006491424B1

(12) United States Patent
Tardy

(10) Patent No.: US 6,491,424 B1
(45) Date of Patent: Dec. 10, 2002

(54) APPARATUS FOR SETTING GEMS AND PROVIDING HIDDEN COMPARTMENTS IN A TIMEPIECE

(75) Inventor: Pierre Tardy, Clifton, NJ (US)

(73) Assignee: Christian Bernard Stores Corp., Secaucus, NJ (US)

( * ) Notice: Subject to any disclaimer, the term of this patent is extended or adjusted under 35 U.S.C. 154(b) by 0 days.

(21) Appl. No.: 09/629,136

(22) Filed: Jul. 31, 2000

(51) Int. Cl.[7] ..... G04B 37/00; G04B 39/00
(52) U.S. Cl. ..... 368/283; 368/285; 368/296
(58) Field of Search ..... 368/88, 276, 281, 368/283, 285, 294–296, 309

(56) References Cited

U.S. PATENT DOCUMENTS 1,972,522 A * 9/1934 Keller ..... 368/278
2,636,338 A * 4/1953 Dinstman ..... 368/283
2,948,106 A * 8/1960 Blumstein ..... 368/278
4,525,077 A * 6/1985 Ketwer ..... 368/77
4,734,895 A 3/1988 Grosskopf
4,800,738 A 1/1989 Bunz
5,119,350 A 6/1992 Delacretaz et al.
5,400,304 A 3/1995 Offenstein
5,574,701 A * 11/1996 Harilela ..... 368/223
6,052,338 A * 4/2000 Shevins ..... 368/223

* cited by examiner

*Primary Examiner*—Vit Miska
(74) *Attorney, Agent, or Firm*—Stephen E. Feldman

(57) ABSTRACT

A timepiece, such as a watch, having a protective cover with a gem set therein. The protective cover may be crystal, plastic or any other transparent and durable material. The protective cover has an aperture having concentric cuts. The setting is seated in the aperture and secured to the protective cover. The setting is configured to be of a similar size and shape as the aperture so that it may be securely affixed to the protective cover. A gasket may be inserted between the setting and the aperture to create a watertight seal in the watch cover. The timepiece may also have a hinged, hidden compartment on the backside of the watch frame. Engravings may be made in the hidden compartment, and small, thin objects may be stored therein.

17 Claims, 6 Drawing Sheets

APPARATUS FOR SETTING GEMS AND PROVIDING HIDDEN COMPARTMENTS IN A TIMEPIECE

FIELD OF THE INVENTION

The present invention relates to the field of jewelry, and, more particularly, to an improved timepiece in which a gem, such as a diamond, may be securely set in a protective timepiece cover, such as a watch crystal. The timepiece further includes a hinged compartment hidden in the support casing of the timepiece. A message and/or photo may be engraved on the inner surface of the hinged compartment. Similarly, small thin objects, such as paper and coins, may be stored therein.

BACKGROUND OF THE INVENTION

Personal timepieces or watches, whether digital or analog, wrist watch, pocket watch, fob watch, ring or pin watch, are well known. Some watches are enhanced in value and appearance by the use of precious and/or semi-precious metal, stones and/or jewels. Other timepieces have other embellishments, some of which add to the information provided by the timepiece and/or add to the enchantment of the timepiece.

U.S. Pat. No. 4,734,895 to Grosskopf discloses a timepiece that includes a pendulum-like support for carrying an exposed jewel. Bearings are mounted so as to permit the exposed jewel to revolve in the space between the face of the watch and the crystal covering the face. The path of the movable exposed jewel is about an axis that is concentric with the arbors supporting the hands of the watch.

U.S. Pat. No. 4,800,738 to Bunz discloses a gem setting having a holding body with a borehole. The gem to be set in the setting also has a borehole. An elastic connecting member is placed between the boreholes to set the gem in place.

U.S. Pat. No. 5,119,350 to Delacretaz et al discloses a timepiece which has a decorative pattern fixed to an arbor of one of the hands, such as the seconds hand arbor so that the decorative pattern rotates with the supporting arbor.

The U.S. Pat. No. 5,400,304 to Offenstein discloses an ornamental clock in which decorative stones or jewels are glued to the underside of the transparent crystal covering the face of the clock. The glue used to secure the decorative elements to the underside of the crystal is transparent.

Other timepieces, such as pocket watches and fob watches, have an openable compartment that encloses the watch face and watch cover. However, objects should not be stored in the compartment, because they may cause damage to the watch cover, especially where a watch crystal is used.

While the prior art is of interest, it does not address the particular need to secure a gem setting to a watch cover, such as a watch crystal. Furthermore, the prior art does not address the particular need to provide a hinged, hidden compartment on a timepiece for engraving messages and storing small objects. The present invention seeks to solve these long felt needs.

SUMMARY OF THE INVENTION

The present invention provides a personal timepiece or watch having a transparent watch cover that protects the face of the watch. A setting for retaining a decorative element, such as a jewel or precious stone, is secured to the watch cover. Preferably, the decorative element is set in the setting so that a center of the decorative element is essentially over the pivot point of the hour and minute hands of the timepiece. This prevents the decorative element from interfering with respect to viewing the time display of the timepiece.

From a further aspect, the present invention provides a hinged, hidden compartment in which engravings may be made and small objects may be stored. Although other timepieces, such as pocket watches and/or fob watches, have an openable cover over the face of the watch; the present invention provides an openable compartment on the backside of the timepiece. When the timepiece is a wristwatch, the present invention provides a hidden compartment essentially covered by the case supporting the works of the timepiece. Unlike a pocket watch, the hinged, hidden compartment of the present invention is located on the backside of the watchcase and need not be opened to view the face of the timepiece.

It is an object of the present invention to provide an apparatus for securing a setting to a protective cover of a timepiece, such as a watch crystal.

It is another object of the present invention to securely set a gemstone, such as a diamond, in the setting secured to a protective cover of a timepiece.

It is another object of the present invention to provide a watertight seal where a gem is set in a crystal watch face.

It is another object of the present invention to provide a hidden compartment, capable of opening and closing, on the underside of a timepiece, such as a wristwatch.

Other objects will become apparent from the foregoing description.

BRIEF DESCRIPTION OF THE DRAWINGS

The following description of preferred embodiments of the present invention will be better understood when read in conjunction with the appended drawings. It should be understood, however, that the invention is not limited to the precise arrangements shown in which.

DETAILED DESCRIPTION OF THE INVENTION

The present invention is directed toward a timepiece having a unique setting in a watch cover coupled with a hinged, hidden compartment in the underside of the timepiece. The apparatus of the present invention is of broad applicability in many technical fields. For illustrative purposes only, a preferred embodiment of the present invention is described below.

A setting 87 and a hinged, hidden compartment 47 of the present invention may be integrated with a variety of watches and timepieces. For illustrative purposes only, the general structure of a watch with which the setting 87 and compartment 47 may be integrated is described below. It should be noted, however, that the present invention is not limited to the watch described as other watches may be used as well.

Figure 2:
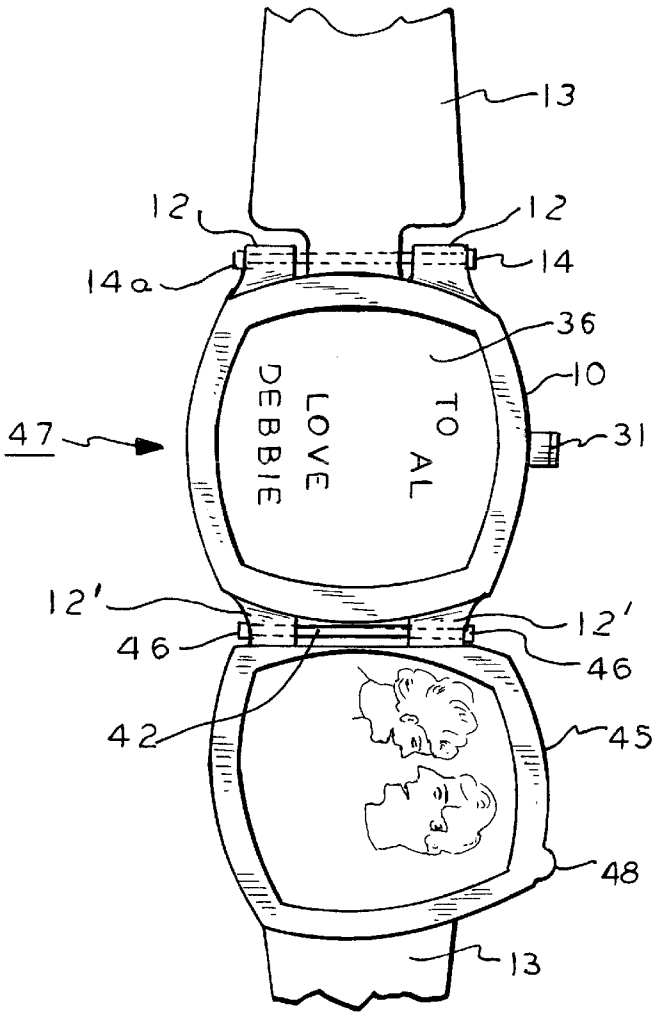
FIG. 2 is a rear view of the watch of FIG. 1, wherein the hinged, hidden compartment of the present invention is shown.
Figure 1:
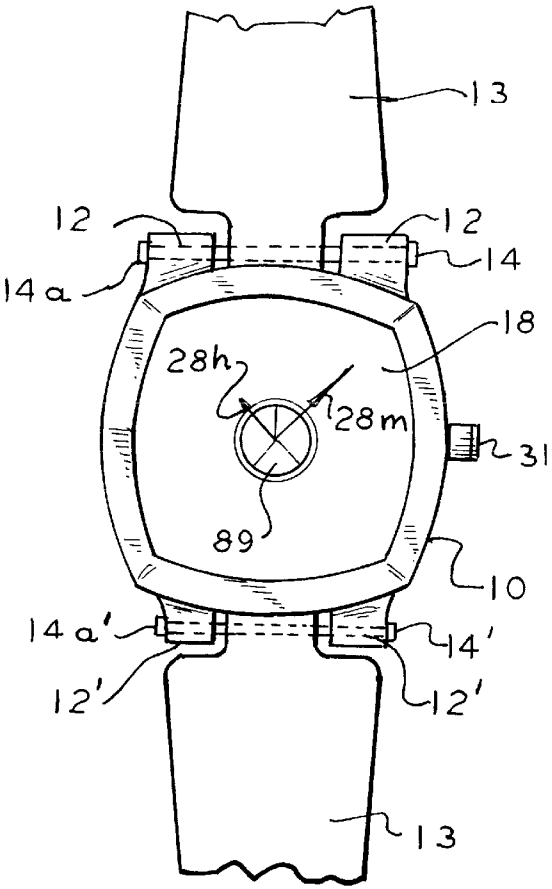
FIG. 1 is a front view of a watch having a gem set to a watch cover.
Figure 3:
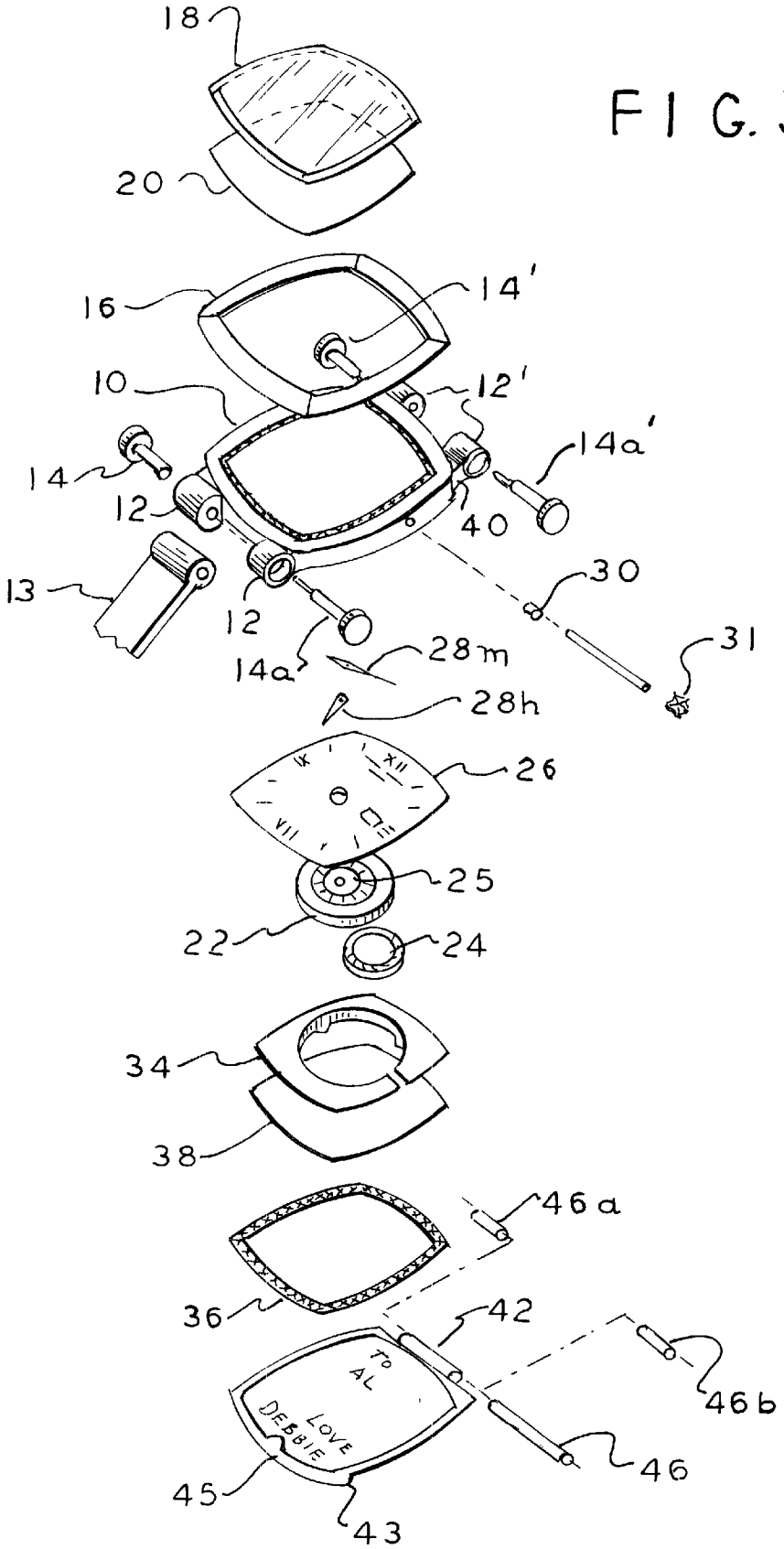
FIG. 3 is a representation of a timepiece, in exploded view, having a case adapted for wearing the timepiece on the wrist of a person.

Referring to FIGS. 1–3, a wristwatch having a frame 10 and watchband pin mountings 12 and 12' are shown. Preferably, the frame 10 should be fabricated from metal such as steel. However, frame 10 may be fabricated from other materials, including, but not limited to, gold and platinum. Watch band pins 14, 14*a*, 14' and 14*a*' are inserted into the mounting ports of the mountings from opposite sides of the mountings 12 and 12'. The watchband pins 14, 14*a*, 14' and 14*a*' are screwed together to form a pin for holding a watchband 13 between the mountings 12 and 12'. A bezel 16 covers the upper surface of the frame 10. The bezel 16 may be fabricated from the same material as the frame, but may have a high polish or decorative finish. Alternatively, the bezel 16 may be fabricated from precious or semi-precious material such as silver, gold, onyx or some other material. A protective watch cover 18 and a gasket 20 are secured to the upper face of the frame 10 providing protection for the watch face. The protective watch cover 18 may be crystal, glass, plastic or any other transparent material capable of providing protection to the watch.

Referring to FIG. 3, watch movement 22 is represented with a battery 24. Extending from the watch movement 22 are at least two concentric shafts 25 that pass through a center port in the face 26. The hands 28*h*, the hour hand, and 28*m*, the minute hand are attached to one of the two concentric shafts, respectively. A hands adjusting pin 30 and an attached crown 31 connect to the movement 22 and adjust the position of the hands 28*h* and 28*m*, as desired. The watch movement 22 is held inside the watchcase by a movement holding plate, which is retained in the frame 10. A case back 36 and a gasket 38 press-fit into the back of the frame 10, thereby, closing the watchcase. While the components, described above, represent the general structure of a wristwatch that may be utilized with the setting 87 and compartment 47 of the present invention, other watches and timepieces may also be implemented with the present invention.

Having described the general structure of a watch that may be used with the present invention, the structure of the compartment 47 is described below.

Referring to FIGS. 1–3, each pin pair 14/14*a* and 14'/14*a*' are passed through the pin receiving ports in one of the spaced pair of pin mountings 12 and 12', respectively, and through the end of the wrist band positioned between the spaced pin mountings, securing the wrist band to the watch case. This procedure for securing a wristband to a wrist watch case is well known.

The spaced pair of pin mountings 12' each include aligned pin receiving ports 40, only one of which is shown. Attached to a cover 45 is a hinge pin retainer 42, which is adapted to fit in the space between pin mounting 12' located below the wristband. When cover 45 is positioned on the back of the case 36 so that the hinge pin retainer 42 is between the spaced pin mounting 12', the hinge pin 46 is inserted into one of the pin receiving ports 40. The hinge pin 46 passes through the hinge pin retainer 42 and into the other pin receiving port 40, thereby, holding the cover 45 over the back of the case 36.

Figure 10A:
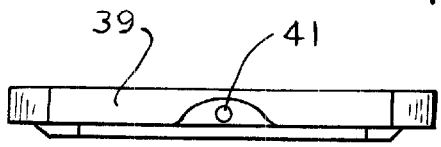
FIG. 10*a* is a side view of a lip component of the ball bearing locking assembly of FIG. 10.
Figure 10:
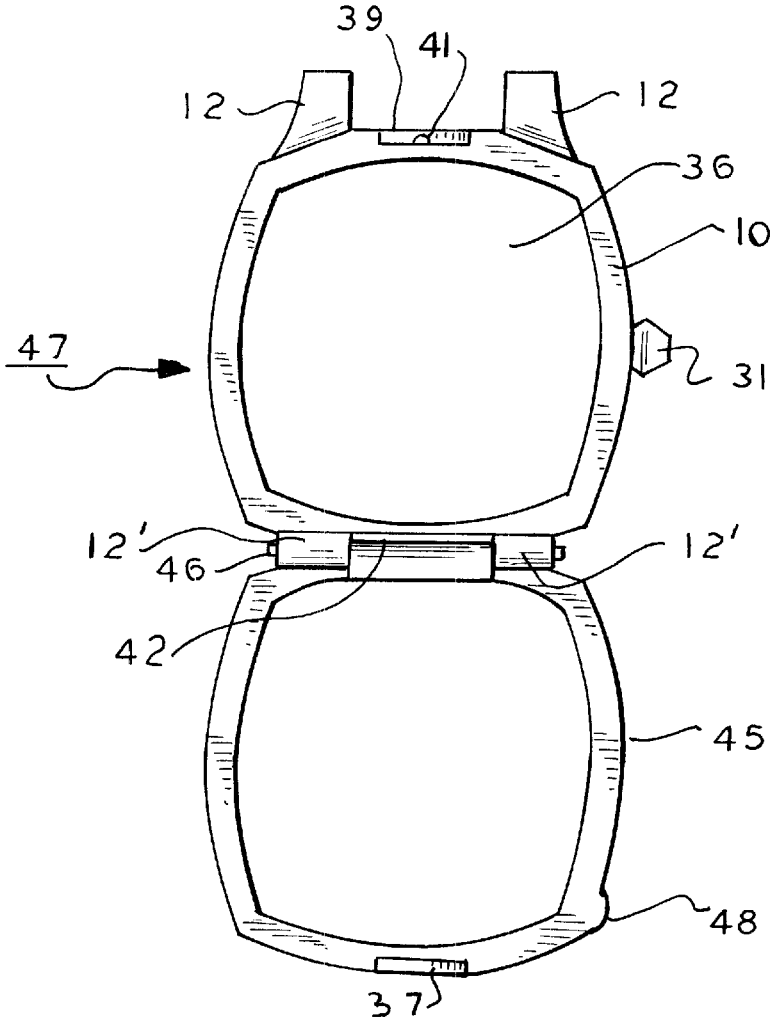
FIG. 10 is rear view of the watch of the present invention having a ball bearing locking assembly.
Figure 10B:
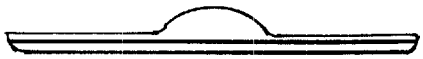
FIG. 10*b* is a side view of the ball bearing component of the ball bearing locking assembly of FIG. 10.

Closure of the cover 45 over the back of the case 36 forms a personal compartment 47 on the back of the watchcase. The cover 45 may snap into a recess in the back of the case 36, thereby, locking the personal compartment 47. In one embodiment, a ball bearing locking mechanism is used to secure the case 36 to the cover 45, when in a closed position. Referring to FIGS. 10, 10*a* and 10*b*, a curved lip 37 is secured to the outer edge of the case 36. The cover 45 is equipped with a slotted groove 39. A ball bearing 41 is fixed within the slotted groove 39. When cover 45 is rotated to a closed position, the edge of lip 37 interlocks with the outer edge of ball bearing 41 and the inner edge of the slotted groove 39. As a result, the personal compartment is securely locked.

A personal message and/or photo may be engraved on the inner surface of case 36 and cover 45. When the personal compartment is closed, the engraved message and/or photo are concealed. However, a wearer of the watch may open the compartment when desiring to view the engraved message and/or photo. Similarly, small thin objects, such as paper and coins, may be stored in compartment 47. An extended comer 48 on cover 45 provides a secluded lip or tab. Extended comer 48 may be utilized to open and close the compartment 47, when the timepiece is removed from one's wrist. When the watch is worn, the personal compartment 47 is locked securely between the case and the wrist. If the watch is a pocket watch or fob watch or other type of watch, the cover for the personal compartment 47 will remain closed because the cover of the compartment snaps into a recess on the back of the case or the back cover of the case. On a pocket watch, fob watch or other personal watch that does not include a watchband and watchband pin mounts, the pin mountings may be modified. In addition, where a single hinge pin 46 is mentioned, two hinge pins, such as 46*a* and 46*b* may be used, as an alternate hinge pin arrangement.

The following materials describe the method and apparatus for setting a gem, such as a diamond, in a watch cover, such as a cover 18.

Figure 4:
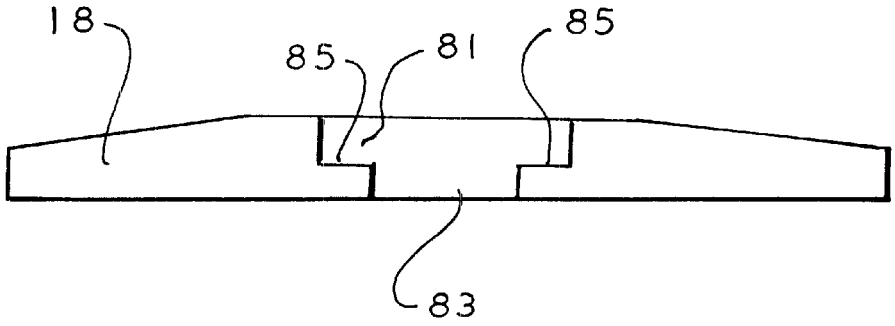
FIG. 4 is a cross-sectional view of a watch cover, wherein the watch cover has concentric cuts for receiving the gem setting of the present invention.
Figure 5:
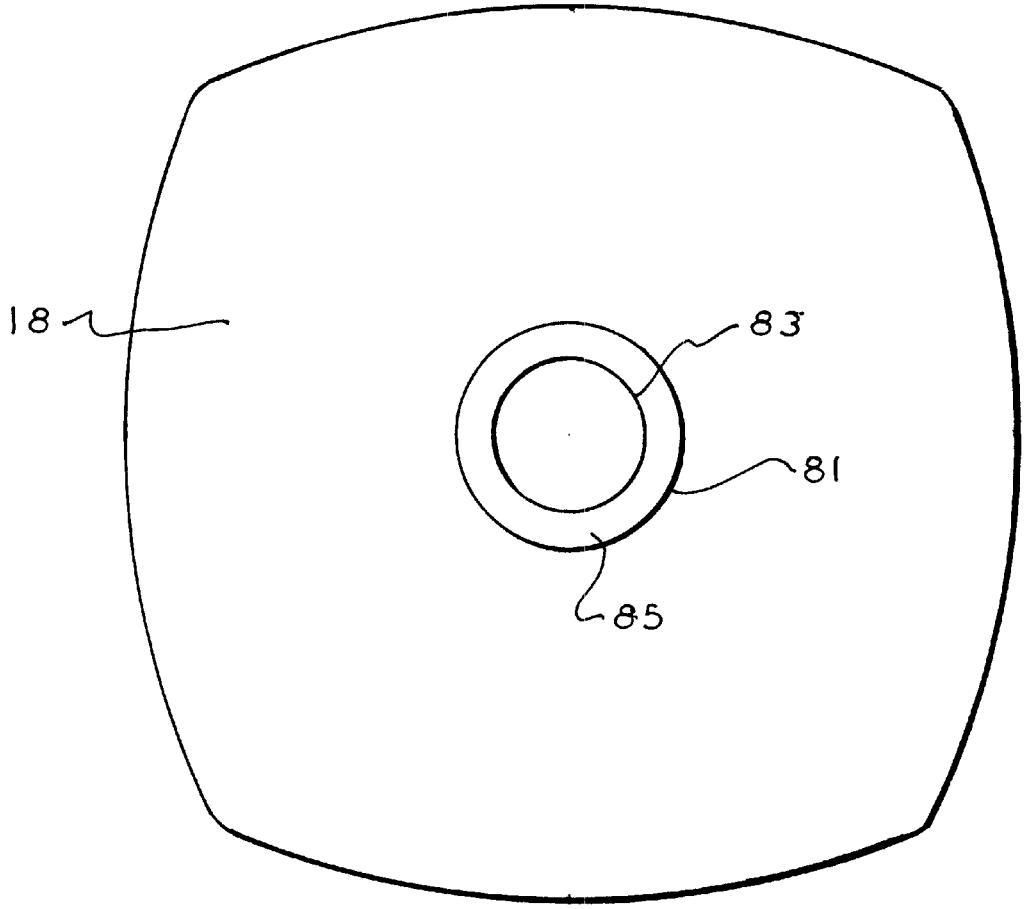
FIG. 5 is a plan view of the watch cover of FIG. 4.

Referring to FIGS. 4 and 5, an aperture should be cut through cover 18 so that a setting 87 may be set therein. Preferably, cover 18 is a crystal watch cover. The aperture should consist of two concentric cuts, openings 81 and 83. The first concentric cut, opening 81 should be cut from the top end of cover 18 and terminate at an intermediate point in cover 18. The second concentric cut, opening 83, should be cut from the terminal point of opening 81, and, be cut through the remaining portion of cover 18. Opening 81 should have a larger diameter than opening 83. The diameters of the concentric cuts may vary according to the size of the setting 87 and gem 89 to be set in the cover 18. A ledge 85 is formed within the cover 18 between the concentric cuts, openings 81 and 83. Preferably, opening 81 is cut at a depth of approximately 60% of the thickness of the cover 18 with opening 83 cut at approximately 40%. However, the depth of each cut may vary according to the dimensions of the setting 87.

The structure of the setting 87 is described below. Setting 87 should be placed in and secured to the openings 81 and 83 of cover 18. Accordingly, setting 87 should have a shape that conforms to the shape of the concentric cuts, i.e., openings 81 and 83. For ease of understanding, the outer portion of setting 87 is first described. The inner portion of setting 87 is described, thereafter.

Figure 6:
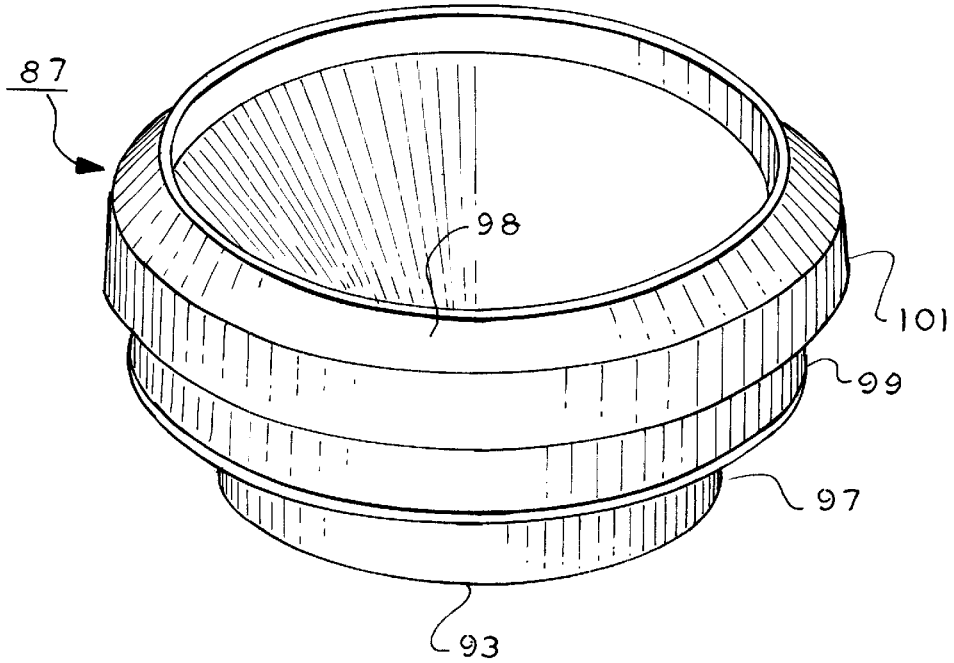
FIG. 6 is a perspective view of the setting used in the present invention.
Figure 7:
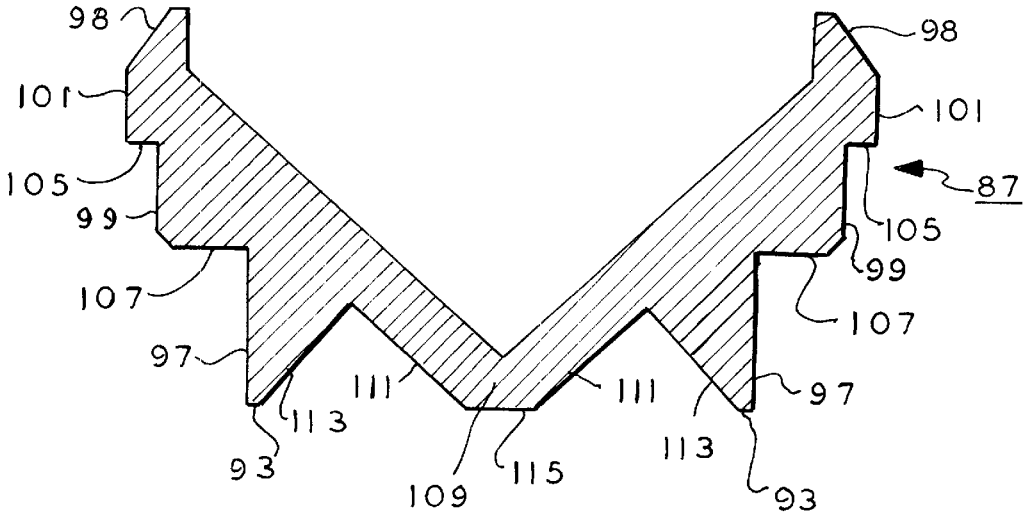
FIG. 7 is a cross-sectional view of the setting shown in FIG. 6.
Figure 8:
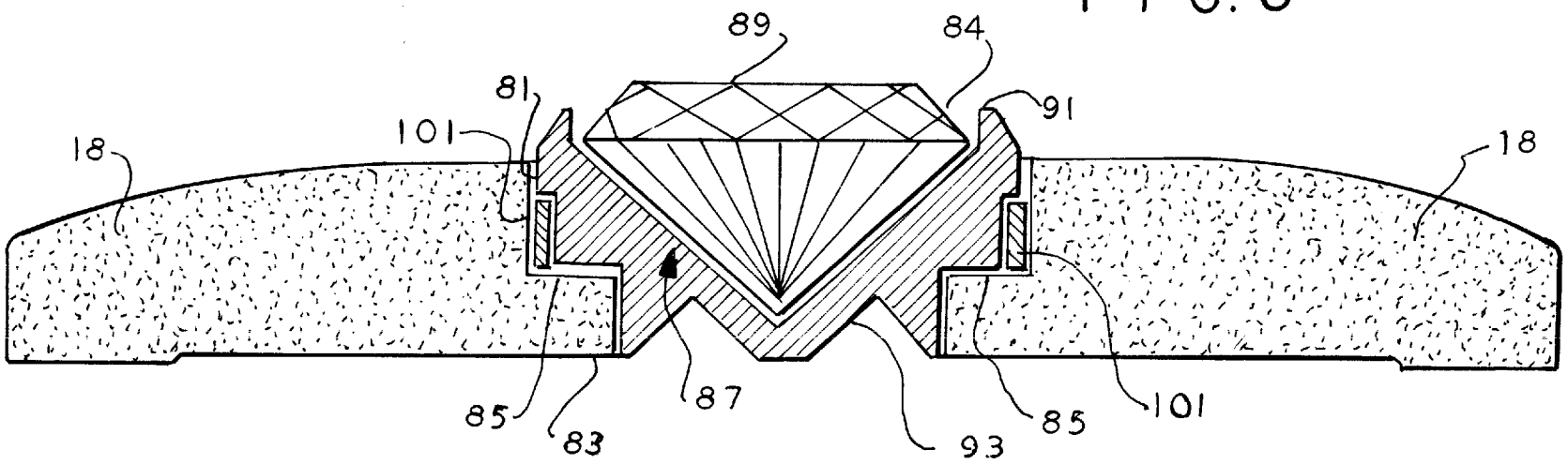
FIG. 8 is cross-sectional view of the watch cover having the setting and gem secured thereto.

Referring to FIGS. 6–8, the outer portion of setting 87 has three members 97, 99 and 101. The bottom end of the member 97 should have a pliable rivet 93. Similarly, the top end of member 101 should have pliable rivet 98. The first member 97 should have a diameter and depth that is almost equal to, but slightly less than, that of opening 83 of cover 18. The second member 99 should have a diameter less than the diameter of circle 81 of cover 18. A space sufficient for housing a gasket 103 should be created between member 99 and opening 81. The third member 101 should have a diameter almost equal to, but slightly less than, that of opening 81. A first horizontal ledge 107 is formed between members 97 and 99. Similarly, a second horizontal ledge 105 is formed between members 99 and 101. A center member 109 is formed on the underside of setting 87 and within member 97. Center member 109 is a cut out portion within member 97 that is used to create the pointed rivet 93 as shown in FIG. 7. Center member 109 should have a v-like shape. More particularly, center member 109 should have a flat bottom 115 and cone-shaped wall 111. The inner portion of member 97 has a first wall 113 that extends on an angle towards the top of wall 111. The top of walls 111 and 113 join together within member 97. It should be noted, however, that the shape of center member 109 may vary in shape provided that rivet 93 may be formed on the bottom of member 97.

As an example, a one-half karat diamond is set in watch cover 18 having a thickness of 2.5 mm. Watch cover 18 is a watch crystal. The watch cover 18 has an aperture for in which setting 87 is set. The aperture consists of two concentric cuts, wherein opening 81 is cut to a depth of 1.4 mm from the top end of the crystal and opening 83 is cut through the remaining 1.1 mm of the watch cover 18. Opening 81 has a diameter of approximately 6.3 mm and opening 83 has a diameter of approximately 4.1 mm. The setting 87 should be set securely in the aperture.

Accordingly, member 97 has a diameter of approximately 4.0 mm, member 99 has a diameter of approximately 5.7 mm, member 101 has a diameter of approximately 6.2 mm and center member 109 has a diameter of approximately 2.4 mm. The space between member 99 and opening 81 (for housing gasket 103) should be approximately 0.25 mm. It should be noted, the dimension described herein may vary according to the size of the gem 89 and the size and shape of the aperture in cover 18.

Having described the outer portion of the setting 87, the inner portion is now described. A precious gem may be set in the inner portion of setting 87. Accordingly, the inner portion of setting 87 should have a conical shape so that a gem 89, such as a diamond, may rest securely within setting 87. Once the gem 89 is placed in the setting 87, the rivet 98 should be riveted on top of the diamond, thereby securing the gem 89 to the setting 87. The setting 87 maybe a white or yellow gold metal adapted to receive and retain a gem 89. The gem 89 may be a precious gem, such as a diamond, ruby, emerald or sapphire or other semiprecious gems or materials.

Figure 9:
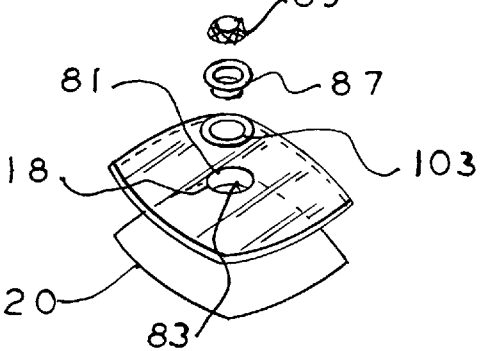
FIG. 9 is a representation, in exploded view, of the watch face assembly and setting of the present invention.

With reference to FIGS. 8 and 9, the method securing setting 87 to watch cover 18 and setting a gem 89 therein is described below.

Before placing setting 87 in cover 18, the circular rubber gasket 103 is placed on top of ledge 85. The gasket 103 should be of a sufficient size and shape so that it is capable resting securely in the space created between opening 81 and member 99. Preferably, the gasket 103 is a washer. With the gasket 103 in place, the setting 87 should be placed in the aperture. When properly inserted, ledge 105 rests on the top edge of gasket 103. Similarly, ledge 107 of setting 87 rests on top of the ledge 85. Rivet 93 should be riveted around the underside of cover 18.

With the setting secured to the protective cover 18, the gasket 103 is pressed securely between member 99 and opening 81. As a result, a watertight seal between the cover 18 and the setting 87 is created. This will prevent water from leaking into the watch and causing damage to the watch. With setting 87 secured to watch cover 18, a gem 89 (such as a diamond) is placed in the setting. Rivet 98 is riveted over the gem 89, thereby securing the gem in the setting.

In the foregoing description of the invention, reference to the drawings certain terms have been used for conciseness, clarity and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented or described.

Having now described a preferred embodiment of the invention, in terms of features, discoveries and principles, along with certain alternative construction and suggested changes, other changes that may become apparent to those skilled in the art may be made, without departing from the scope of the invention.

What is claimed is:

1. A time piece having a protective cover comprising:

an opening in said protective cover;

a setting corresponding to the shape of said opening and configured to be seated securely in said opening, said setting having means for securing said setting said protective cover; and, means for securing a gemstone to said setting.

2. The timepiece of claim 1 wherein said opening further comprises a first cut concentric with a second cut and a ledge between said first cut and said second cut of said cover;

said setting further comprises an inner portion having a shape similar to the shape of said gemstone to be set in said setting; and, an outer portion comprising a first member, a second member and a third member, said first member having a circumference sufficient to be seated securely within said first cut;

said second member having a circumference less than the circumference of said first cut, wherein a space is created between said first cut and said second member when said setting is set in said opening; and, said third member having a circumference sufficient to be seated within said second cut;

said means for securing an article to said setting is located at the top end of said first member; and, said means for securing said setting to said protective cover is located at the bottom end of said third member.

3. The timepiece of claim 2 further comprising a gasket placed on said ledge of said protective cover;

a first ledge between said first member and said second member of said outer portion of said setting wherein said first ledge is placed on top of said gasket when seated on said ledge of said protective cover; and, a second ledge between said second member and said third member, wherein said second ledge is placed on top of said ledge of said protective cover and adjacent to said gasket.

4. The timepiece of claim 3 further comprising a central member within said third member and in the underside of said setting.

5. The timepiece of claim 1 wherein said protective cover is crystal;

said inner portion of said setting has a conical shape; and, said gemstone has a conical shaped bottom and is set in said inner portion of said setting.

6. The timepiece of claim 1 wherein said timepiece is a watch having a bottom member; and, said bottom member comprises a hinged panel attached to said bottom member, said panel capable of opening and closing whereby a hidden compartment is formed on the bottom of said watch.

7. The timepiece compartment of claim 6 further comprising a first spaced mounting means secured to a first side of said frame and a second spaced mounting means secured to a side opposite said first side, said first spaced mounting means having spaced hinge pin receiving ports adjacent said bottom member of said frame, said hinge of said panel adapted to be positioned in a space defined by said first spaced mounting means, said hinge having a hinge pin chamber in alignment with said spaced hinge pin receiving ports; and, a hinge pin means received by and retained in said hinge pin receiving ports; and, said hinge pin chamber for securing said panel to said back member of said frame.

8. The timepiece of claim 6, further comprising a first curved member affixed to said bottom member of said frame, a second curved member affixed to said panel, said panel is coupled to said frame for closing said compartment;

a ball bearing attached to said second curved member, wherein said first curved member engages said second curved member and said ball bearing means.

9. The timepiece of claim 7, wherein said panel further comprises a tab means extending from a portion thereof, opposite said hinge, for applying pressure on said panel for moving said panel between an opened and closed position.

10. The timepiece of claim 6, wherein said timepiece is a watch.

11. The timepiece of claim 10, further comprising a protective cover affixed to said top member, said protective cover having a first cut concentric with a second cut;

a ledge between said first cut and said second cut of said protective cover;

a setting having an inner portion having a shape similar to the shape of the gemstone to be set in said setting;

an outer portion comprising a first member, a second member and a third member, wherein the circumference of said first member is larger than the circumference of said second and third members and the circumference of said second member is larger than the circumference of said third member;

a first ledge between said first member and said second member of said outer portion of said setting;

a second ledge between said second member and said third member;

means for securing said gemstone to said setting, said means for securing said gemstones is located at the top end of said first member; and means for securing said setting to the protective cover, said means for securing said setting located at the bottom end of said third member.

12. The apparatus of claim 11, wherein said protective cover is crystal and a gemstone is set in said setting.

13. A setting to retain a gemstone in a protective cover of a time piece comprising an inner portion having a shape similar to the shape of the gemstone to be set in said setting;

an outer portion comprising a first member, a second member and a third member, wherein the circumference of said first member is larger than the circumference of said second and third members, and, the circumference of said second member is larger than the circumference of said third member;

a first ledge between said first member and said second member of said outer portion of said setting;

a second ledge between said second member and said third member;

means for securing said gemstone to said setting, said means for securing said gemstones is located at the top end of said first member; and, means for securing said setting to the protective cover, said means for securing said setting located at the bottom end of said third member.

14. The setting of claim 13, further comprising a central member located on the underside of said setting.

15. The setting of claim 13, further comprising a gasket in which said setting may be placed in said gasket so that said first ledge of said setting rests on top of said gasket.

16. The setting of claim 13, wherein said setting is made of gold.

17. The setting of claim 13, wherein said setting is made of silver.

* * * * *